US008230714B2

(12) United States Patent
Intagliata et al.

(10) Patent No.: US 8,230,714 B2
(45) Date of Patent: Jul. 31, 2012

(54) DIE CARRIER ASSEMBLY AND CRIMPING PROCESS

(75) Inventors: Joseph V. Intagliata, Hanna, IN (US); Joshua T. Ruge, Porter, IN (US)

(73) Assignee: Custom Machining Services, Inc., Valparaiso, IN (US)

( * ) Notice: Subject to any disclaimer, the term of this patent is extended or adjusted under 35 U.S.C. 154(b) by 444 days.

(21) Appl. No.: 12/691,863

(22) Filed: Jan. 22, 2010

(65) Prior Publication Data

US 2011/0023573 A1 Feb. 3, 2011

Related U.S. Application Data

(60) Provisional application No. 61/146,703, filed on Jan. 23, 2009.

(51) Int. Cl.
*B23P 19/04* (2006.01)
*B21D 41/04* (2006.01)

(52) U.S. Cl. ..... 72/402; 72/416; 29/237; 100/232

(58) Field of Classification Search ..... 72/399, 72/402, 409.01, 416; 29/237; 100/232
See application file for complete search history.

(56) References Cited

U.S. PATENT DOCUMENTS

| | | | | |
|---|---|---|---|---|
| 5,323,697 | A * | 6/1994 | Schrock | 100/232 |
| 5,697,135 | A * | 12/1997 | Dischler | 29/237 |
| 6,044,686 | A * | 4/2000 | Dischler | 72/402 |
| 6,257,042 | B1 * | 7/2001 | Valimaki et al. | 72/402 |
| 7,788,779 | B2 * | 9/2010 | Frenken | 29/237 |
| 2005/0125978 | A1 * | 6/2005 | Frenken | 29/237 |

* cited by examiner

*Primary Examiner* — David B Jones
(74) *Attorney, Agent, or Firm* — Hartman & Hartman P.C.; Gary M. Hartman; Domenica N. S. Hartman

(57) ABSTRACT

A die carrier assembly configured for use in a crimping machine. The assembly includes die carriers disposed in a circumferential arrangement and adapted for radially inward and outward travel. Each die carrier has oppositely-disposed circumferential extents that define circumferential gaps between adjacent pairs of the die carriers. Shoes are disposed radially inward from the die carriers and are adapted for radially inward and outward travel with the die carriers. The shoes travel radially inward and outward with the die carriers between positions in which the shoes define minimum and maximum openings, respectively, of the die carrier assembly. At least one of the shoes is disposed radially inward from one of the circumferential gaps between at least one adjacent pair of the die carriers. The circumferential extents of the adjacent pair of die carriers define interdigitated fingers that support the shoe when the die carrier assembly is at its maximum opening position.

19 Claims, 7 Drawing Sheets

DIE CARRIER ASSEMBLY AND CRIMPING PROCESS

CROSS REFERENCE TO RELATED APPLICATIONS

This application claims the benefit of U.S. Provisional Application No. 61/146,703, filed Jan. 23, 2009, the contents of which are incorporated herein by reference.

BACKGROUND OF THE INVENTION

The present invention generally relates to crimping machines that utilize interacting die segments adapted to radially travel toward each other to diametrically crimp components together, such as a fitting to a hose. More particularly, this invention relates to a crimper assembly configured to increase the radial travel capability of its die segments and thereby increase the size of the opening that can be defined by the die segments during loading of the crimper assembly with components to be crimped.

Crimping machines adapted to crimp fittings, ferrules, etc. to hoses, pipes and other components are well known. A notable example is the CustomCrimp® CC Series of crimping machines, which are available in a variety of sizes to crimp hoses with diameters of up to about ten inches (about 25 cm). A CustomCrimp® CC Series crimping machine 10 is schematically represented in FIGS. 1 and 2. To facilitate the description of the machine 10 provided below, the terms "vertical," "horizontal," "upper," "lower," "above," "below," etc., will be used in reference to the perspective of the orientation of the machine 10 in FIGS. 1 and 2, and therefore are relative terms and should not be otherwise interpreted as limitations to the installation and use of the machine 10.

The crimping machine 10 of FIGS. 1 and 2 is represented as comprising a frame 12 in which a die carrier assembly 14 and actuator assembly 16 are mounted. The actuator assembly 16 is located below the die carrier assembly 14 and is adapted to raise and lower a cradle 18 that supports part of the die carrier assembly 14. Actuation is typically with hydraulic power, such as a hydraulic cylinder, though it is foreseeable that mechanical actuation or some other means of actuation could be used. In the embodiment of FIGS. 1 and 2, the die carrier assembly 14 is represented as comprising four master die carriers 20, adapted to collapse eight intermediate master dies or shoes 22A and 22B toward each other for the purpose of diametrically crimping two components together, such as a fitting onto a hose or tube (not shown). Those skilled in the art will appreciate that various types of dies and adapters (not shown) can be assembled to the die carrier assembly 14 in order to adapt the machine 10 for crimping different types and sizes of components. Because the dies and adapters are mounted to the radial inner extents of the shoes 22A and 22B, the crimping diameter of the die carrier assembly 14 is less than the minimum shoe opening, $D_{min}$, identified in FIG. 2.

FIGS. 1 and 2 show the crimping machine 10 with its die carriers 20 and shoes 22A and 22B in the fully open and fully closed positions, respectively. In FIG. 1, the cradle 18 is in a lowered position between a pair of side rails 24. The lower die carrier 20 is supported by and preferably secured within a notch 26 at the upper end of the cradle 18, such that the lower die carrier 20 moves with travel of the cradle 18. The upper die carrier 20 is secured within a notch 28 defined in the frame 12, and the side die carriers 20 are mounted between the upper and lower die carriers 20 and capable of moving laterally inward and outward. Compression springs 30 are located between each circumferentially-adjacent pair of shoes 22A and 22B to maintain uniform circumferential spacing between the shoes 22A and 22B and engagement of the shoes 22A and 22B with the die carriers 20. As evident from FIGS. 1 and 2, each of the four shoes 22A located at the 3, 6, 9 and 12 o'clock positions is supported within a notch 20A defined solely by one of the die carriers 20, whereas the remaining shoes 22B are supported by adjacent pairs of the carriers 20. FIG. 3 depicts an exploded view of the die carrier assembly 14, showing the carriers 20, shoes 22A and 22B and springs 30. FIG. 3 also shows alignment bolts 32 that ensure proper radial alignment of the shoes 22A with their corresponding carriers 20 is maintained as the die carrier assembly 14 is actuated between the fully open and fully closed positions of FIGS. 1 and 2. and alignment screws and nuts 34 that ensure proper circumferential alignment of the carriers 20 and shoes 22A and 22B occurs when the die carrier assembly 14 is in the fully closed position of FIG. 2.

As the cradle 18 and the lower die carrier 20 travel upward from the fully open position of FIG. 1 to the fully closed position of FIG. 2, the side die carriers 20 cam against inclined surfaces of the notches 26 and 28, causing the side die carriers 20 to move laterally inward. As a result, relative motion occurs in which all four die carriers 20 and their shoes 22A and 22B effectively travel in radially inward directions relative to each other. As evident from FIG. 2, the effective diameter defined by the radially inward extents of the shoes 22A and 22B decreases from a maximum opening diameter $D_{max}$ in FIG. 1 to a minimum opening diameter $D_{min}$ in FIG. 2. Relative movement of each pair of diametrically opposed shoes 22A and 22B is substantially along the effective diameter defined by the radially inward extents of the shoes 22A and 22B at any given moment.

As previously noted with respect to FIGS. 1 and 2, the shoes 22B are supported by adjacent pairs of the die carriers 20. As evident from FIG. 1 and as clarified by the isolated view of the carriers 20 and shoes 22B in FIG. 4, in the fully open position the circumferential extents 22C of each shoe 22B are supported by circumferential extents 20C of two of the die carriers 20, which are separated by a circumferential gap 36 located along a radial of the maximum and minimum diameters $D_{max}$ and $D_{min}$ of the die carrier assembly 14. The gaps 36 are uniform in width as evident from FIG. 6. The gap 36 between die carriers 20 cannot exceed the circumferential lengths of the shoes 22B, as doing so will cause the shoes 22B to be unsupported and, under the force of the compression springs 30, cause the shoes 22B to become wedged between the carriers 20. Though increasing the circumferential lengths of the shoes 22B would allow for greater diametrical expansion of the die carrier assembly 14 and have the effect of increasing $D_{max}$ in FIGS. 1 and 3, this will also undesirably affect the crimping capability of the die carrier assembly 14 by increasing $D_{min}$ in FIGS. 2 and 5. As such, for a given desired crimp diameter, the configuration of the die carriers 20 and shoes 22A and 22B limits the amount of radial die travel and, therefore, the maximum die opening ($D_{max}$) for a given desired crimping diameter.

While the die carrier assembly 14 represented in FIGS. 1 through 6 is adequate for many applications, limitations can be encountered if the hose or other component to be crimped has an elbow or another geometric shape or feature that results in the component having other than a uniform circular outer perimeter that is continuous along the length of the component that must pass through the maximum die opening ($D_{max}$) As fitting manufacturers continue to modify the sizes and designs of fittings and ferrules, the versatility of crimping machines can become inadequate, with the result that existing crimping machines capable of crimping nearly every existing fitting in the past cannot do so today.

In view of the above, it would be desirable if the radial die travel of a crimping machine could be increased to increase the die opening ($D_{max}$) without also causing an increase in the crimping diameter ($D_{min}$).

BRIEF DESCRIPTION OF THE INVENTION

The present invention provides a die carrier assembly configured to increase the radial travel capability of its die shoes, and thereby increase the size of the opening that can be defined by die segments during loading of the crimper assembly with components to be crimped.

According to a first aspect of the invention, the die carrier assembly includes a plurality of die carriers and a plurality of shoes. The die carriers are disposed in a circumferential arrangement and are adapted for radially inward and outward travel relative to a centerline of the circumferential arrangement. Each die carrier has oppositely-disposed circumferential extents that define circumferential gaps between adjacent pairs of the die carriers. The shoes are disposed radially inward from the die carriers and are adapted for radially inward and outward travel with the die carriers. The shoes travel radially inward and outward with the die carriers between positions in which the shoes define minimum and maximum openings, respectively, of the die carrier assembly. At least a first of the shoes is disposed radially inward from one of the circumferential gaps between at least a first of the adjacent pairs of the die carriers. According to a particular aspect of the invention, the circumferential extents of the first adjacent pair of die carriers define interdigitated fingers that support the first shoe when the shoes are in the position that defines the maximum opening of the die carrier assembly. In a preferred embodiment of the invention, contact between the first shoe and the first adjacent pair of the die carriers is limited to the interdigitated fingers when the shoes are in the position that defines the maximum opening of the die carrier assembly.

Other aspects of the invention include crimping processes that use the die carrier assembly described above.

A technical effect of this invention is that the interdigitated fingers of the die carriers are capable of providing support for the die shoes at increased die openings relative to prior art crimper assemblies. This allows for the travel from the end of the segment to the centerline plus the common travel from the centerline, enabling maximum travel and die opening for the crimper. This in turn makes the common footprint of each crimper manufactured to have in relation more travel and more opening than prior art crimpers.

Other aspects and advantages of this invention will be better appreciated from the following detailed description.

DETAILED DESCRIPTION OF THE INVENTION

Figure 1:
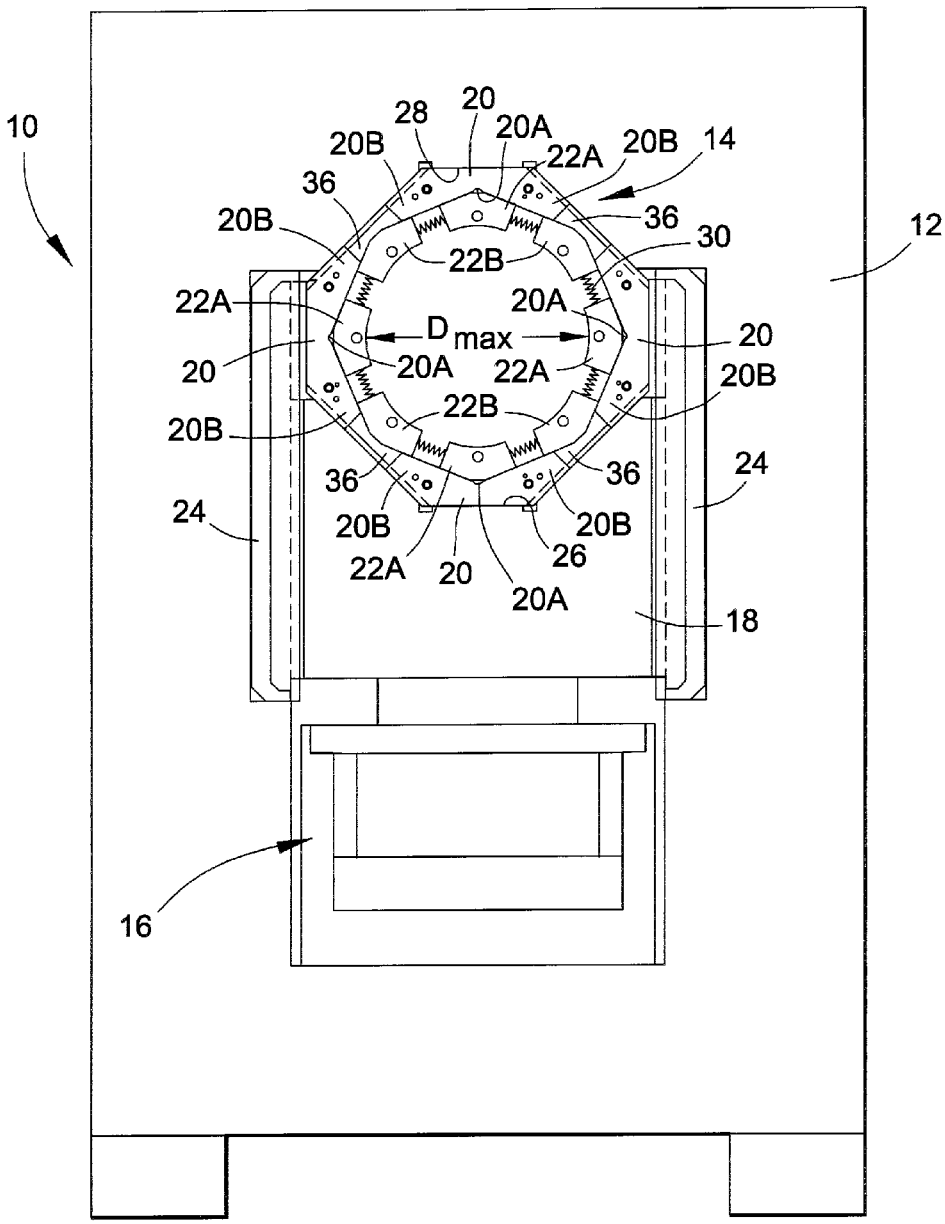
FIG.1 Prior Art
FIGS. 1 and 2 schematically represent a crimping machine of a type known in the prior art.
Figure 2:
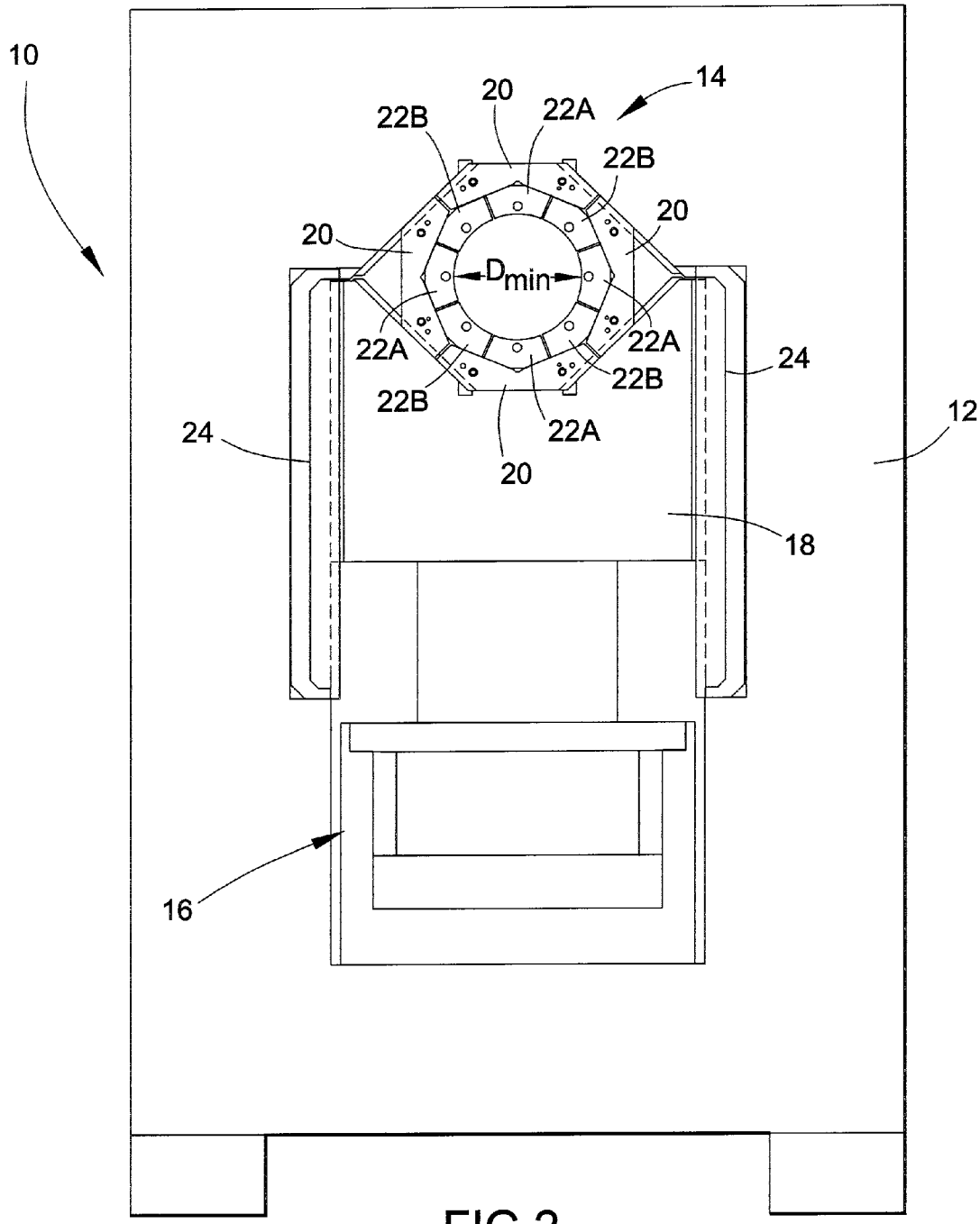
FIG.2 Prior Art
Figure 3:
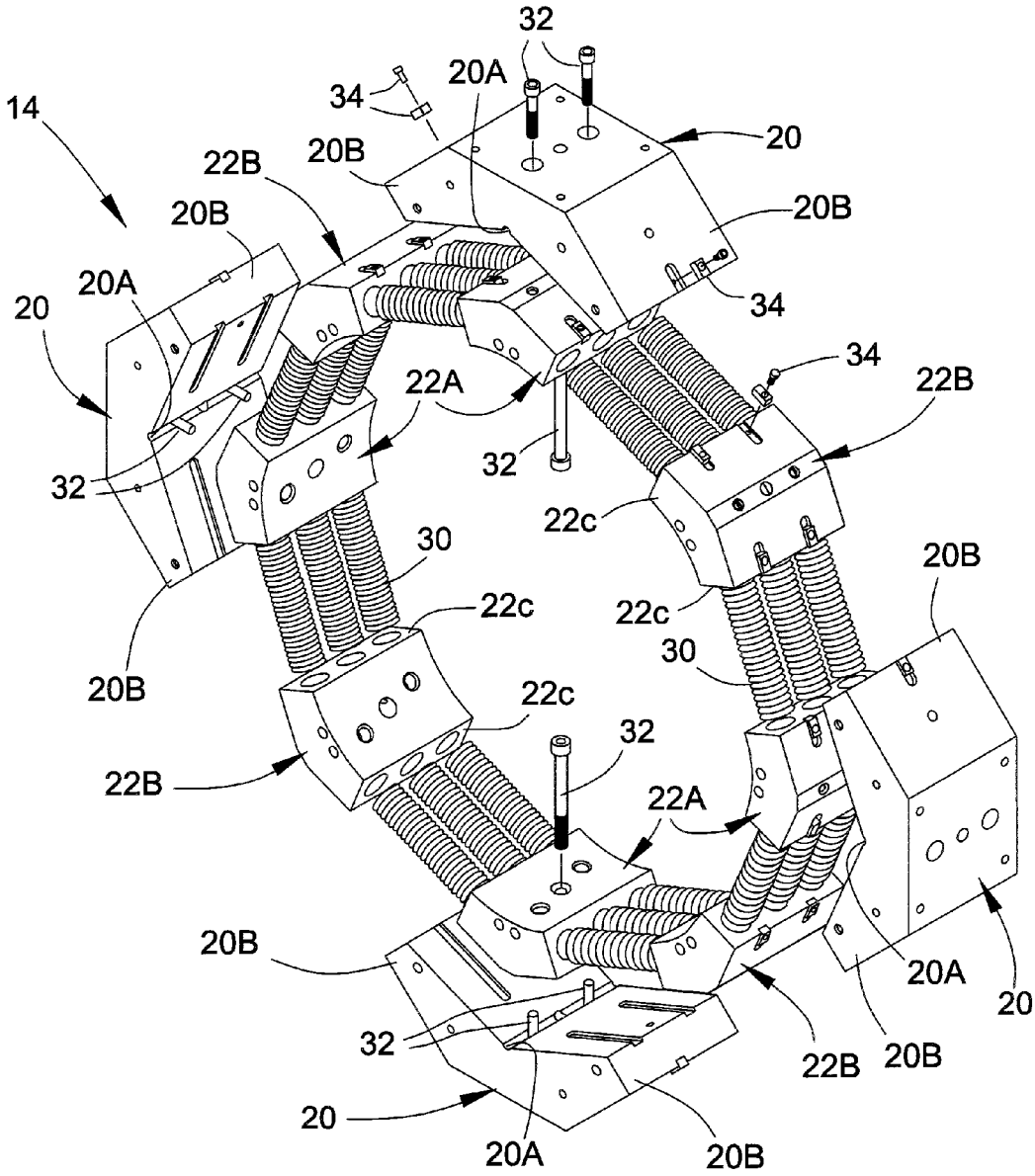
FIG.3 Prior Art
FIG. 3 is an exploded view of a crimper assembly of the crimping machine of FIGS. 1 and 2.
Figure 4:
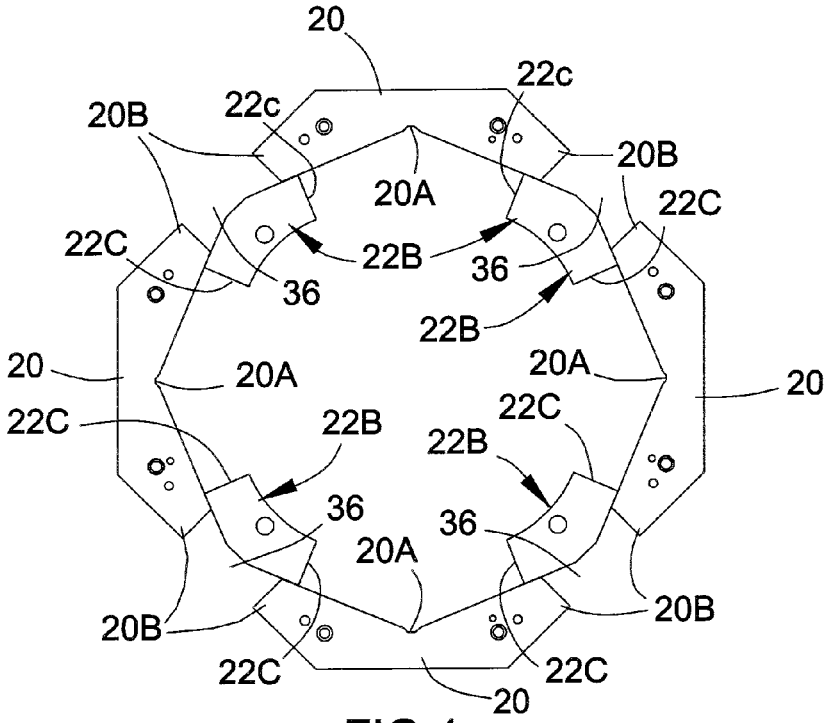
FIG.4 Prior Art
FIGS. 4 and 5 are isolated views of die carriers and four of eight shoes shown in FIGS. 1 through 3, and depict the carriers and shoes in fully open and fully closed positions, corresponding to FIGS. 1 and 2, respectively.
Figure 6:
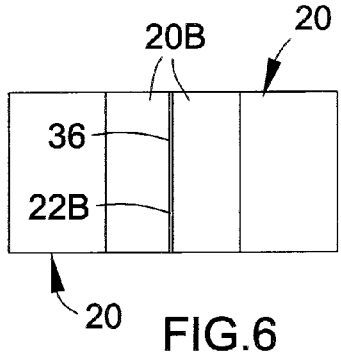
FIG.6 Prior Art
FIG. 6 is a side view of FIG. 5.
Figure 5:
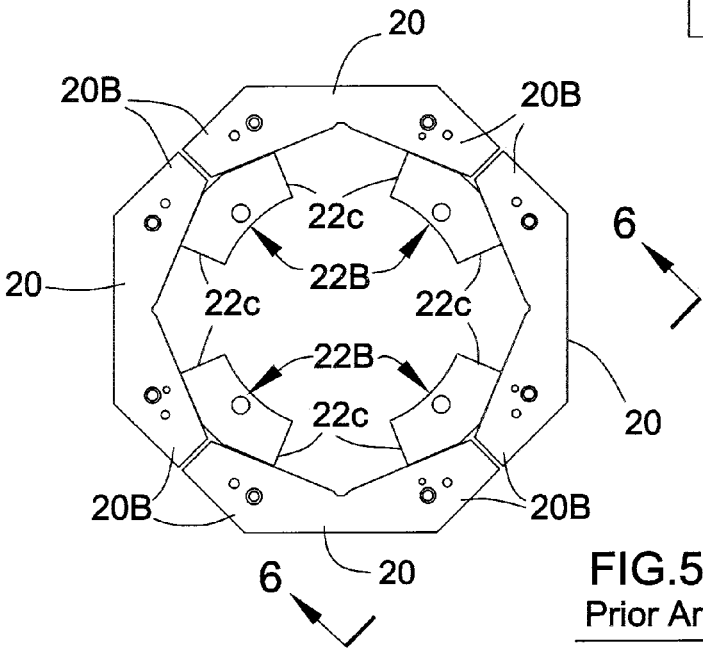
FIG.5 Prior Art
Figure 7:
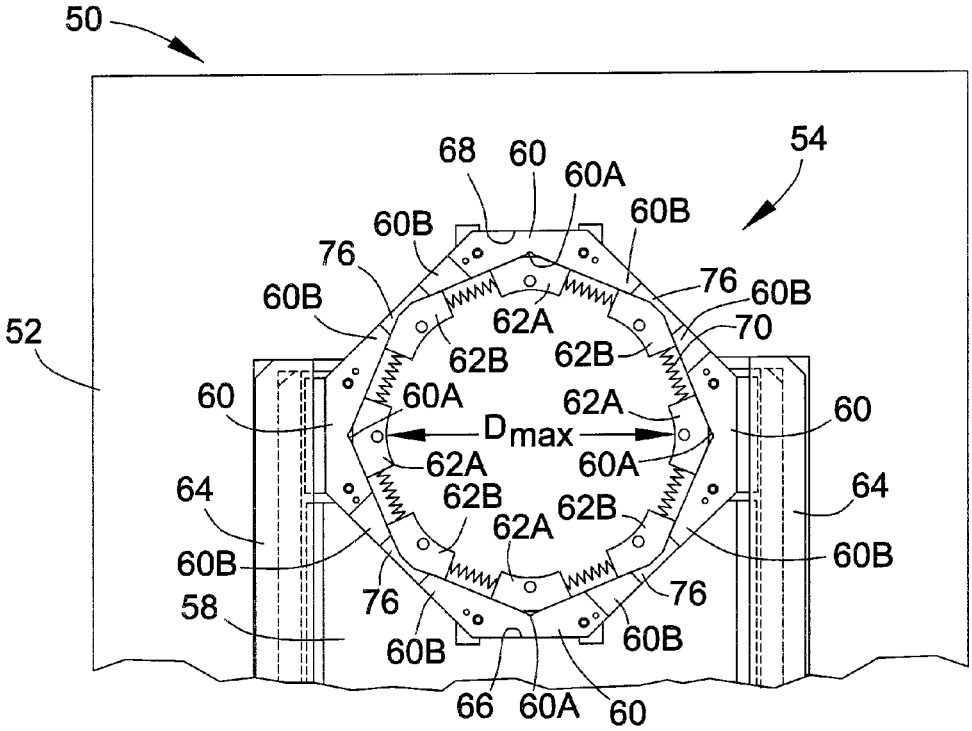
FIGS. 7 and 8 schematically represent a crimper assembly in fully open and closed positions, respectively, in accordance with an embodiment of the invention.
Figure 8:
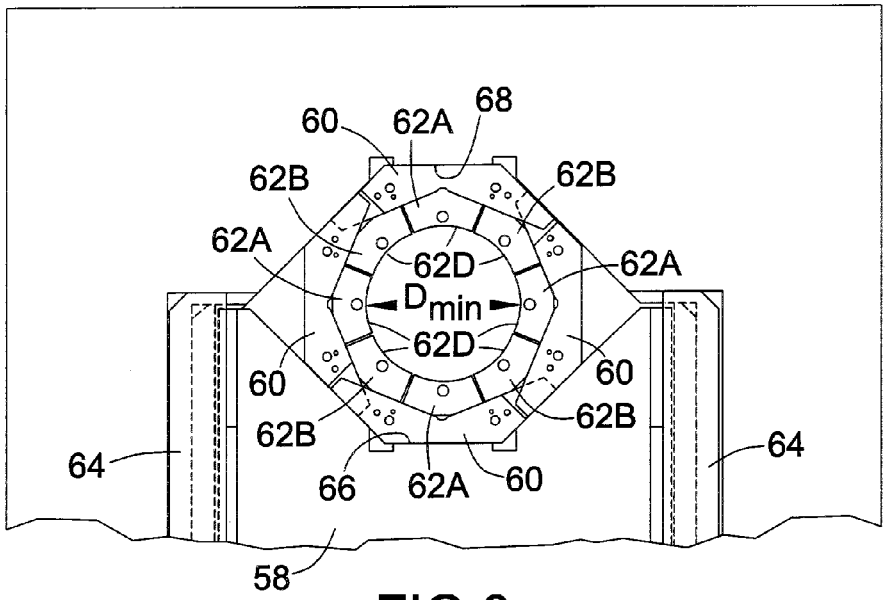

A die carrier assembly 54 representative of an embodiment of this invention is depicted in FIGS. 7 and 8, and components of the die carrier assembly 54 are represented in isolation in FIGS. 9 through 12. The die carrier assembly 54 can be used in a crimping machine of the type represented in FIGS. 1 and 2, as well as other machines with various other configurations. As will become evident from the following discussion, the die carrier assembly 54 is configured to allow greater die carrier travel and a larger maximum opening for the same footprint of an existing crimping machine.

To facilitate the description of the die carrier assembly 54 and its installation and use in a crimping machine, the terms "vertical," "horizontal," "upper," "lower," "above," "below," etc., will be used in reference to the perspective of the orientation shown in FIGS. 7 through 12, and therefore are relative terms and should not be interpreted as otherwise limiting the scope of the invention.

Similar to the prior art of FIGS. 1 through 6, the die carrier assembly 54 is represented as being mounted in a frame 52 of a crimping machine 50. The assembly 54 is preferably configured to be actuated by an actuator assembly (not shown), so that travel of a cradle 58 located below the die carrier assembly 54 and between a pair of rails 64 serves to cause relative travel of the components of the assembly 54, resulting in the fully open and fully closed positions of the assembly 54 represented in FIGS. 7 and 8, respectively. Actuation can be achieved with hydraulic power, such as a hydraulic cylinder, though it is foreseeable that mechanical actuation or some other means of actuation could be used.

Also similar to the prior art of FIGS. 1 through 6, the die carrier assembly 54 is represented as comprising four master die carriers 60, adapted to collapse eight intermediate dies or shoes 62A and 62B toward each other for the purpose of diametrically crimping two components together, such as a fitting onto a hose or tube (not shown). The radially inward extents 62D of the shoes 62A and 62B define the perimeter of the minimum shoe opening, $D_{min}$, identified in FIG. 8, and each shoe 62B is disposed between an adjacent pair of the shoes 62A, such that the shoes 62A and 62B are arranged in a circumferential alternating pattern. Those skilled in the art will appreciate that more or fewer carriers 60 and shoes 62A and 62B could be employed in the assembly 54, and that the invention is not limited to the particular embodiment represented in FIGS. 7 through 12. Furthermore, various types of dies and adapters (not shown) can be assembled to the die carrier assembly 54 for the purpose of crimping different types and sizes of components. Because such dies and adapters would be mounted to the radial inner extents 62D of the shoes 62A and 62B, the crimping diameter of the die carrier assembly 54 is less than the minimum shoe opening, $D_{min}$, shown in FIG. 8.

In FIGS. 7 and 8, the lower die carrier 60 is supported by and preferably secured within a notch 66 at the upper end of the cradle 58, such that the lower die carrier 60 moves with travel of the cradle 58. The upper die carrier 60 is secured within a notch 68 defined in the frame 52, and the side die carriers 60 are mounted between the upper and lower die carriers 60 and capable of moving laterally inward and outward. Compression springs 70 (or other suitable biasing elements) are located between each circumferentially-adjacent pair of shoes 62A and 62B to maintain uniform circumferential spacing between the shoes 62A and 62B and bias the shoes 62A and 62B radially outward into engagement with the die carriers 60. The four shoes 62A located at the 3, 6, 9 and 12 o'clock positions (as viewed in FIGS. 7 and 8) are supported within recesses or notches 60A defined in each of the die carriers 60 between circumferential extents 60B thereof. The remaining shoes 62B are supported by adjacent pairs of the carriers 60. Other components of the die carrier assembly 54, such as those depicted in FIG. 3 of the prior art, are not depicted in FIGS. 7 and 8, though it should be understood that such components may be used in the die carrier assembly 54 of this invention.

As the cradle 58 and the lower die carrier 60 travel upward from the fully open position of FIG. 7 to the fully closed position of FIG. 8, the side die carriers 60 cam against inclined surfaces or ramps defined by the notches 66 and 68, causing the side die carriers 60 to simultaneously move laterally and in unison with the lower die carrier 60. As a result, relative motion occurs in which all four die carriers 60 effectively travel in radially inward directions relative to each other. As evident from FIG. 8, the effective diameter defined by the radially inward extents 62D of the shoes 62A and 62B decrease from a maximum opening diameter $D_{max}$ in FIG. 7 to a minimum opening diameter $D_{min}$ in FIG. 8. Relative movement of each pair of diametrically opposed shoes 62A and 62B is substantially along the effective diameter defined by the radially inward extents 62D of the shoes 62A and 62B at any given moment.

As with the prior art die carrier assembly 54 of FIGS. 1 through 6, the shoes 62B of the die carrier assembly 54 are supported by adjacent pairs of die carriers 60. As more clearly shown in the isolated views of FIGS. 11 and 12, which show a single shoe 62B supported by an adjacent pair of the carriers 60, in the fully open position the circumferential extents 62C of each shoe 62B are supported by the circumferential extents 60B of an adjacent pair of the die carriers 60, between which a circumferential gap 76 is defined such that each shoe 62B is disposed radially inward from one of the gaps 76. In contrast to the prior art assembly 14, the gap 76 between the circumferential extents 60B of the carriers 60 is defined by interdigitated fingers 60C, as more clearly seen in FIGS. 9 and 10. The fingers 60C are shown as having substantially equal lengths in the circumferential direction, and as such each gap 76 has a generally uniform width in the circumferential direction. However, because the fingers 60C are interdigitated, each gap 76 is not entirely located along a radial of the maximum and minimum diameters $D_{max}$ and $D_{min}$ of the die carrier assembly 54. As such, the gaps 76 differ from the gaps 36 of the die carrier assembly 14 of FIGS. 1 through 6, which are essentially planar as a result of the extents 20C of the die carriers 20 defining planar surfaces that face each other.

Figure 9:
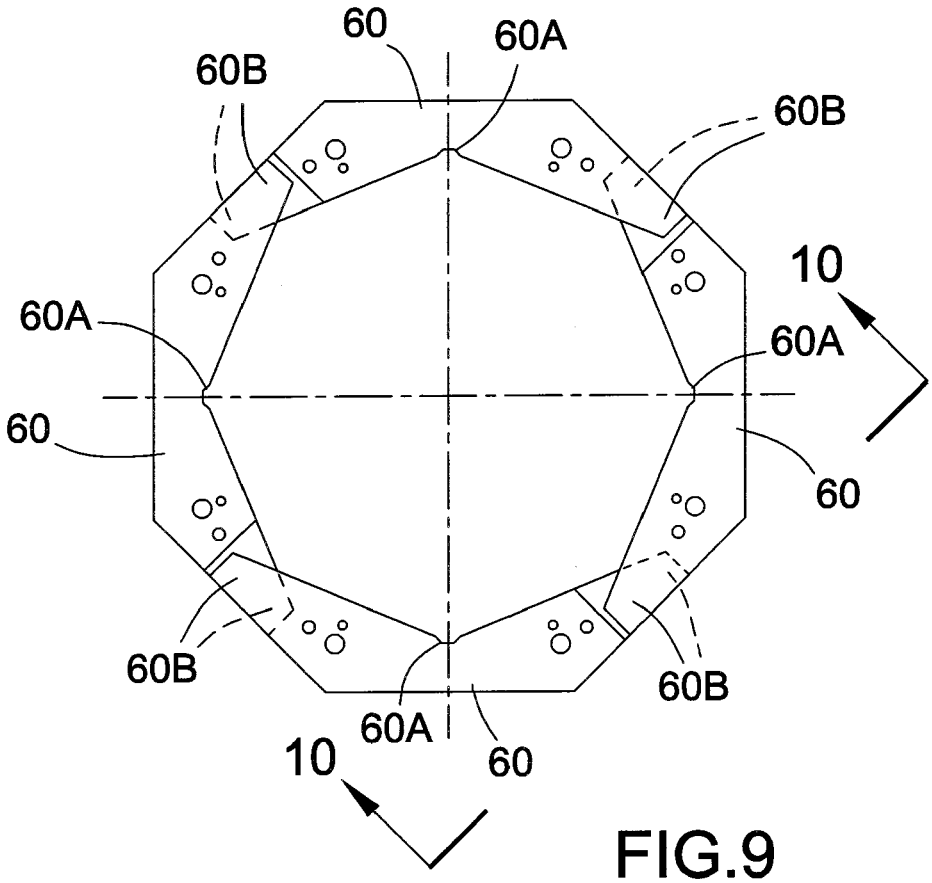
FIG. 9 represents a detailed view of die carriers of the FIGS. 7 and 8.
Figure 10:
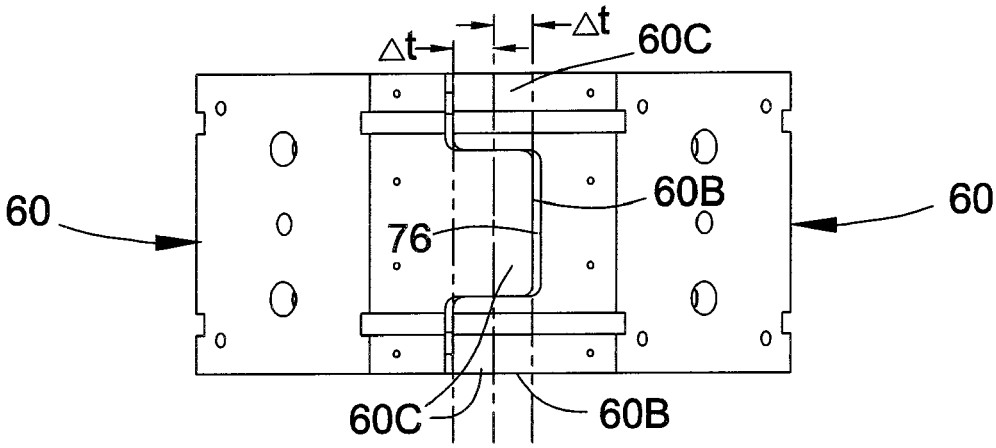
FIG. 10 is a side view of FIG. 9.
Figure 11:
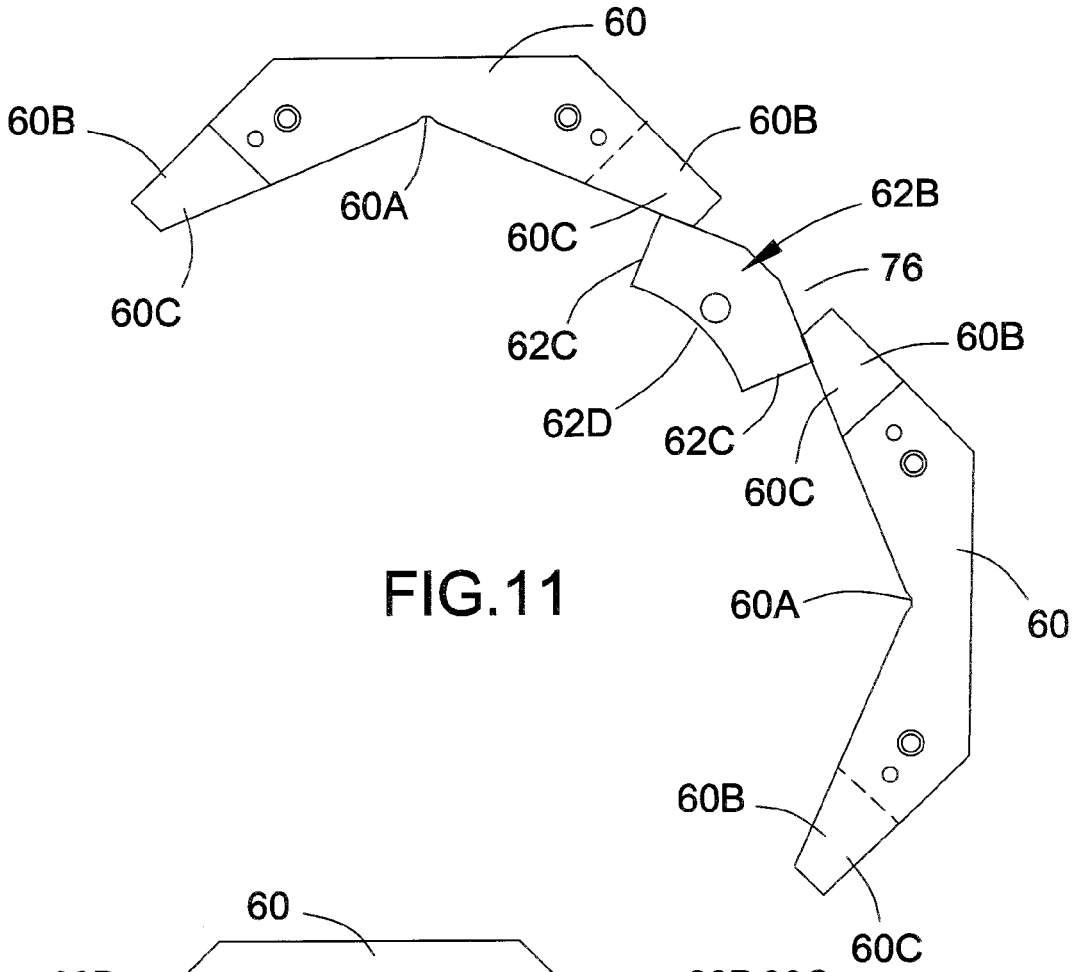
FIGS. 11 and 12 are isolated views of an adjacent pair of the die carriers and one of the shoes shown in FIGS. 7 through 9, and depict the carriers and shoe in the fully open and closed positions corresponding to FIGS. 7 and 8, respectively.
Figure 12:
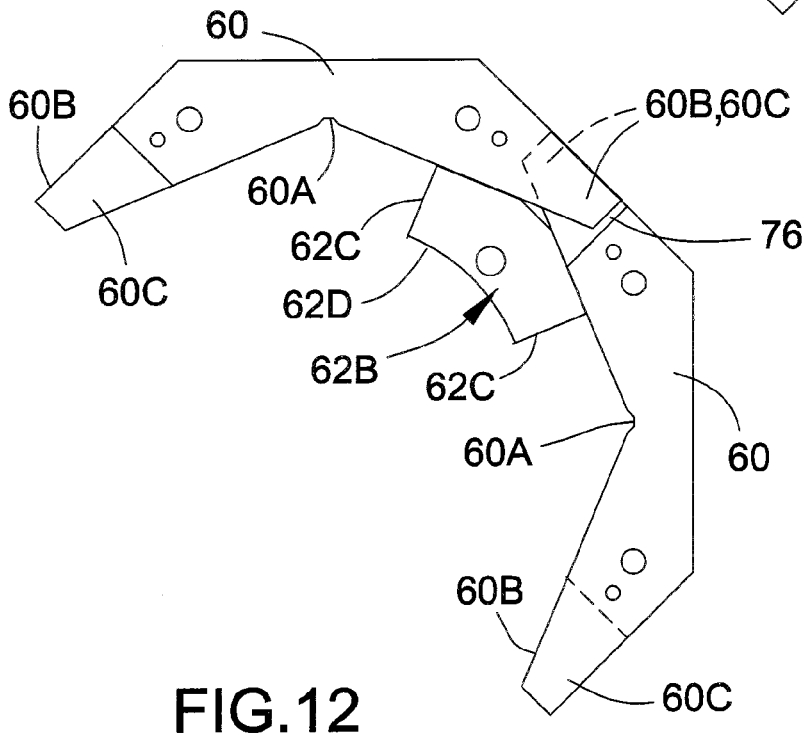

An advantageous effect of the interdigitated fingers 60C is that, at the maximum opening $D_{max}$, the fingers 60C are capable of providing the sole contact between the die carriers 60 and shoes 62B along the circumferential lengths of the shoes 62B, as evident from FIG. 11. Compared to the die carrier assembly 14 of FIGS. 1 through 6, for a given minimum opening $D_{min}$, the carriers 60 can travel radially outward farther than the prior art carriers 20 without the shoes 62B becoming unsupported and possibly wedged between the carriers 60, as also evident from FIG. 11. FIGS. 9 and 10 indicate that the amount of travel in relation to the centerline/axis of the die carrier assembly 54 (FIG. 9) is increased by a distance of $\Delta t$ (FIG. 10), which is about half the circumferential dimensions of the three fingers 60C. As evident from FIG. 12, at the completion of diametrically crimping components together by causing the die carriers 60 and shoes 62A and 62B to travel radially inward from the maximum opening ($D_{max}$), at which point the die carrier assembly 54 is subjected to maximum crimping loads, the shoes 62B are supported by portions of the die carriers 60 (in particular, portions of each carrier 60 between its recess 60A and fingers 60C) in addition to the interdigitated fingers 60C.

In view of the above, a die carrier assembly configured in accordance with this invention allows for greater diametrical expansion, and therefore an increased $D_{max}$ (FIG. 7), without resorting to increasing the circumferential lengths of the shoes 62B and the resulting undesirable affect of increasing $D_{min}$ (FIG. 8). As such, for a given desired crimp diameter, the configuration of the die carriers 60 and shoes 62A and 62B allows for greater die travel and, therefore, increases the maximum die opening ($D_{max}$) for a given desired crimping diameter. Consequently, the die carrier assembly 54 is better suited for crimping fittings, ferrules, etc., onto hoses, pipes, etc., having nonuniform geometries as a result of, for example, the presence of an elbow or another feature that results in the component having other than a uniform and continuous circular outer perimeter. As such, a crimping machine equipped with the die carrier assembly 54 of this invention is capable of being more versatile than prior art crimping machines of the type represented in FIGS. 1 and 2.

While each die carrier 60 is represented in FIG. 10 as having a pair of fingers 60C at one of its circumferential extents 60B and a single finger 60C at its opposite extent 60B, it should be evident that the die carriers 60 could be configured to have any number of fingers 60C capable of meshing in an interdigitated manner, including an even number or an odd number of fingers 60C at each circumferential extent 60C. In a preferred embodiment of the invention, a single finger 60C at one extent 60B of each die carrier 60 is interdigitated between a set of two fingers 60C at the facing extent 60B of the adjacent die carrier 60 to maximize the strength of the die carriers 60 and their fingers 60C, as well as promote a centering effect achieved by having a single finger 60C centrally located widthwise on each die carrier 60.

While the invention has been described in terms of a particular embodiment, it is apparent that other forms could be adopted by one skilled in the art. For example, the die carrier assembly 54 and a crimping machine in which it is installed could differ in appearance and construction from what is shown in the Figures. Therefore, the scope of the invention is to be limited only by the following claims.

The invention claimed is:

1. A die carrier assembly of a crimping machine, the die carrier assembly comprising:

a plurality of die carriers disposed in a circumferential arrangement and adapted for radially inward and outward travel relative to a centerline of the circumferential arrangement, each of the die carriers having oppositely-disposed circumferential extents that define circumferential gaps between adjacent pairs of the die carriers;

a plurality of shoes disposed radially inward from the die carriers and adapted for radially inward and outward travel with the die carriers, the shoes traveling radially inward and outward with the die carriers between positions in which the shoes define minimum and maximum openings, respectively, of the die carrier assembly, at least a first shoe of the shoes being disposed radially inward from one of the circumferential gaps between at least a first of the adjacent pairs of the die carriers;

wherein the circumferential extents of the first adjacent pair of the die carriers define interdigitated fingers that support the first shoe when the shoes are in the position that defines the maximum opening of the die carrier assembly.

2. The die carrier assembly according to claim 1, wherein the shoes have radially inward extents that define the perimeter of the minimum opening.

3. The die carrier assembly according to claim 1, further comprising means for biasing the shoes radially outward against the die carriers.

4. The die carrier assembly according to claim 1, wherein at least one of the die carriers has a recess between the circumferential extents thereof, and at least a second of the shoes is disposed and supported within the recess.

5. The die carrier assembly according to claim 1, wherein the die carrier assembly is installed on a crimping machine.

6. The die carrier assembly according to claim 5, further comprising actuator means for raising and lowering at least a first of the die carriers and simultaneously causing a second of the die carriers and a diametrically-opposed third of the die carriers to travel laterally.

7. The die carrier assembly according to claim 6, wherein a fourth of the die carriers diametrically-opposed to the first die carrier does not move during operation of the actuator means.

8. The die carrier assembly according to claim 1, wherein the interdigitated fingers comprise a single finger defined by the circumferential extent of a first die carrier of the first adjacent pair of the die carriers and two fingers defined by the circumferential extent of a second die carrier of the first adjacent pair of the die carriers.

9. The die carrier assembly according to claim 1, wherein the first shoe is one of a plurality of first shoes, the shoes comprise a plurality of second shoes arranged in a circumferential alternating pattern with the first shoes, and each of the first shoes is disposed between an adjacent pair of the second shoes.

10. The die carrier assembly according to claim 9, wherein all of the first shoes is disposed radially inward from the circumferential gaps between adjacent pairs of the die carriers.

11. The die carrier assembly according to claim 10, wherein all of the circumferential extents of the adjacent pairs of the die carriers define interdigitated fingers that support the first shoes when the first and second shoes are in the position that defines the maximum opening of the die carrier assembly.

12. The die carrier assembly according to claim 1, wherein contact between the first shoe and the first adjacent pair of the die carriers is limited to the interdigitated fingers when the shoes are in the position that defines the maximum opening of the die carrier assembly.

13. A crimping process using the die carrier assembly of claim 1, wherein the process diametrically crimps a first component onto a second component by causing the die carriers and the shoes to travel radially inward from the position in which the shoes define the maximum opening and the interdigitated fingers support the first shoe to the position in which the shoes define the minimum opening and the first shoe is supported by portions of the first adjacent pair of the die carriers in addition to the interdigitated fingers.

14. A die carrier assembly installed in a crimping machine comprising an actuator, the die carrier assembly comprising:

a plurality of die carriers disposed in a circumferential arrangement and adapted for radially inward and outward travel relative to a centerline of the circumferential arrangement, the die carriers comprising a first die carrier raised and lowered by the actuator and diametrically-opposed second and third die carriers that are caused by the actuator to travel laterally simultaneous with the raising and lowering of the first die carrier, each of the die carriers having oppositely-disposed circumferential extents that define circumferential gaps between adjacent pairs of the die carriers;

a plurality of intermediate carriers disposed radially inward from the die carriers and adapted for radially inward and outward travel with the die carriers, the intermediate carriers comprising a plurality of first shoes arranged in a circumferential alternating pattern with a plurality of second shoes whereby each of the first shoes is disposed between an adjacent pair of the second shoes, the first and second shoes traveling radially inward and outward with the die carriers between positions in which radially inward extents of the first and second shoes define minimum and maximum openings, respectively, of the die carrier assembly, each of the first shoes being disposed radially inward from one of the circumferential gaps between the adjacent pairs of the die carriers;

wherein the circumferential extents of the die carriers define interdigitated fingers and contact between the first shoes and the adjacent pairs of the die carriers is limited to the interdigitated fingers when the first and second shoes are in the position that defines the maximum opening of the die carrier assembly.

15. The die carrier assembly according to claim 14, further comprising means for biasing the first and second shoes radially outward against the die carriers.

16. The die carrier assembly according to claim 14, wherein each of the die carriers has a recess between the circumferential extents thereof, and the second shoes are disposed and supported within the recesses.

17. The die carrier assembly according to claim 14, wherein the die carriers comprise a fourth die carrier diametrically-opposed to the first die carrier, wherein the fourth die carrier does not move during operation of the actuator.

18. The die carrier assembly according to claim 14, wherein the interdigitated fingers comprise a single finger defined by a first half of the circumferential extents of the die carriers and two fingers defined by a second half of the circumferential extents of the die carriers, and each of the single fingers is interdigitated between a set of the two fingers.

19. A crimping process using the die carrier assembly of claim 14, wherein the process diametrically crimps a first component onto a second component by causing the die carriers and the shoes to travel radially inward from the position in which the shoes define the maximum opening and the interdigitated fingers support the first shoes to the position in which the shoes define the minimum opening and the first shoes are supported by portions of the adjacent pairs of the die carriers in addition to the interdigitated fingers.

* * * * *